United States Patent [19]

Furze et al.

[11] Patent Number: 4,497,482

[45] Date of Patent: Feb. 5, 1985

[54] FEEDING STACKS OF SHEETS

[75] Inventors: Victor J. Furze; Thomas J. Howlett, both of London, England

[73] Assignee: Molins PLC, London, England

[21] Appl. No.: 403,908

[22] Filed: Jul. 30, 1982

[30] Foreign Application Priority Data

Aug. 4, 1981 [GB] United Kingdom ..... 8123774

[51] Int. Cl.[3] ..... B65H 3/12

[52] U.S. Cl. ..... 271/94; 271/101; 271/166

[58] Field of Search ..... 271/166, 101, 99, 105, 271/134, 94, 165

[56] References Cited

U.S. PATENT DOCUMENTS

| | | | |
|---|---|---|---|
| 1,957,318 | 5/1934 | Bush | 271/166 X |
| 3,947,017 | 3/1976 | Scragnoli | 271/99 |
| 4,105,103 | 8/1978 | Huffman | 271/166 X |
| 4,179,113 | 12/1979 | Gallimore | 271/166 X |

FOREIGN PATENT DOCUMENTS

| | | | |
|---|---|---|---|
| 41304 | 12/1981 | European Pat. Off. . | |
| 52-366 | 6/1977 | Japan | 271/165 |
| 2051013 | 1/1981 | United Kingdom . | |

*Primary Examiner*—Richard A. Schacher
*Attorney, Agent, or Firm*—John C. Smith, Jr.

[57] ABSTRACT

A magazine (2) for stamps is provided with an escapement mechanism in the form of upper and lower gripping means (24, 26) which alternately support the stack of stamps, thereby allowing the stamps to be fed at a constant head to a withdrawal rotor (10). The upper and lower gripping may each be constituted by a rubber tube (38) which is inflatable against the side of the stack via a thin pivotal strip (36).

6 Claims, 3 Drawing Figures

FEEDING STACKS OF SHEETS

This invention relates to apparatus for feeding stacks of sheets, in particular stacks of stamps for application to cigarette packets.

In many sheet processing operations sheets of material are held in a vertical stack from the bottom of which they are withdrawn one at a time for the required processing. For example, in cigarette packing machines revenue or closure stamps are withdrawn singly from the bottom of the stack of stamps by a suction device, each stamp next has a layer of adhesive deposited on it and is then applied to the top end of a cigarette packet. With such machines, which currently operating at speeds in the order of 300 to 400 packets per minute, it becomes necessary for an operator to manually load a new batch of stamps onto the top of the stack at very frequent intervals. If it is attempted to increase the height of the stack, so that a larger batch of stamps can be loaded at a time, problems may arise in the regular withdrawal of stamps at the bottom of the stack, in that the suction device may miss a stamp or withdraw more than one stamp.

According to the present invention there is provided apparatus for feeding a stack of sheet, comprising means defining a stack of superposed sheets, means for withdrawing sheets singly from the bottom of the stack, an upper and a lower gripping means for gripping the sides of the stack, and actuating means to cause said upper and lower gripping means to be alternately actuated so that the part of the stack above the gripping means is supported alternately by the upper and lower gripping means, resulting in an intermittent lowering of said part of the stack as sheets are withdrawn by the withdrawal means.

Preferably a sensor is provided a short distance above the upper gripping means to provide a warning to the operator that the stack requires replenishing. If the level in the stack is always maintained above said sensor, and provided the space between the upper and lower gripping means is small, the weight of the stack above the withdrawal means will remain practically constant, thereby providing optimum conditions for withdrawal of stamps at the bottom of the stack.

Each gripping means may comprise a tubular inflatable member disposed along one side of the stack parallel to the edges of the sheets therein; and the actuating means may then comprise a pair of valves connecting each inflatable member to a source of air pressure, and driven cam means operating alternately on the valves to allow pressure in alternate inflatable members to be released. Between each inflatable member and said one side of the stack there may be interposed a thin pivotal member to distribute the resultant gripping pressure along the edges of the respective sheets.

For a better understanding of the invention, and how it may be put into effect, an example of apparatus according to the invention will now be described with reference to the accompanying drawings, in which.

Figure 1:
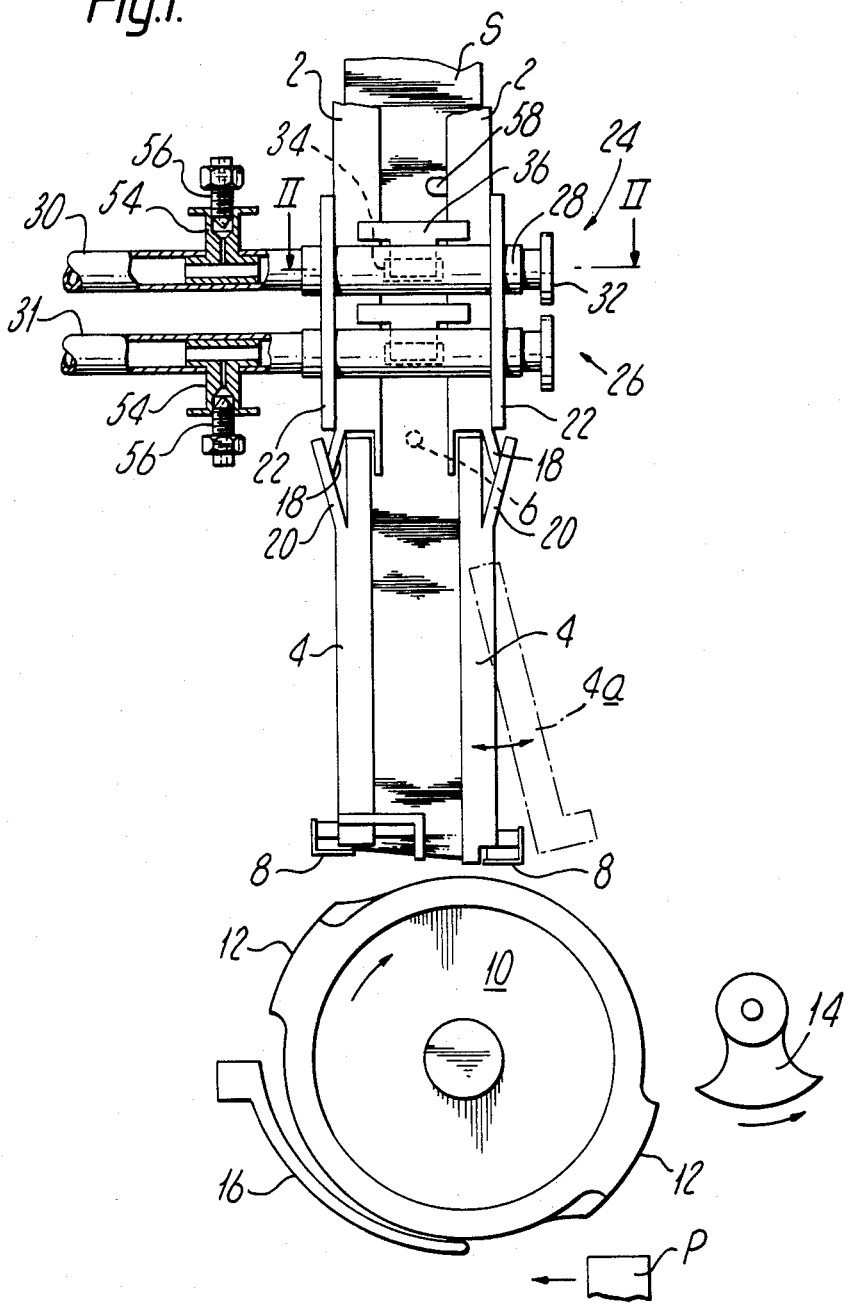
FIG. 1 is a front view of apparatus according to the invention.
Figure 2:
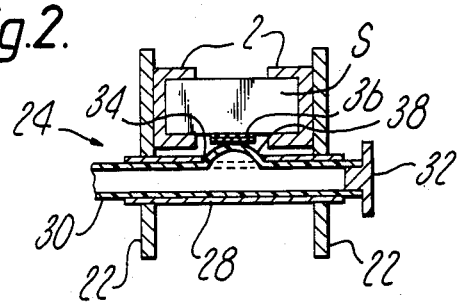
FIG. 2 is a section taken on the line II—II in FIG. 1.

Referring first to FIGS. 1 and 2, there is shown a vertical stack S of rectangular stamps located at each of its two narrower sides in a fixed channel 2 of C-shaped section. Extending downwards from the bottom of the channels 2 are a pair of lower channels 4 similar to the channels 2, but mounted for pivotal movement about a spindle 6 disposed behind the stack S. At the bottom of the lower channels 4 are ledges 8 which support edges of the stack of stamps.

Beneath the stack is a rotor 10 formed with two diametrically opposed raised portions 12 to whose arcuate surfaces suction is applicable.

Pivotal movement is imparted to the lower channels 4 (by means not shown) in timed relation with clockwise rotation of the rotor 10, so that as a raised portion 12 comes into contact with the underside of the lowermost stamp in the stack S, the bottom ends of the channels 4 are pivoted anti-clockwise at a peripheral speed corresponding to that of the rotor. Thus the portion 12 rolls tangentially into contact with the lowermost stamp which is then pulled away from the ledges 8 by suction applied to the rotor 10.

To the right of the rotor 10 is a gumming sector 14 rotatable anti-clockwise at twice the angular speed of the rotor but at the same peripheral speed, and adapted to apply a layer of adhesive to a passing stamp held by suction against a portion 12.

Extending horizontally under the rotor 10 is a conveyor (not shown) which moves towards the left at a speed corresponding to the peripheral speed of the rotor. A succession of packets P (only one shown) are carried by the conveyor in timed relation with movement of the portions 12, so that a stamp with adhesive thereon is transferred to each packet P as the latter moves under a portion 12. A stripper finger 16 extends into grooves (not shown) in the portions 12 to ensure that each stamp is removed as suction is released.

At the junction between the channels 2 and 4 the central parts of the C-shaped sections thereof are bent outwardly to form inclined fingers 18 and 20 respectively. These fingers locate against the narrow sides of the stack S as the lower channel 4 is pivotally moved to its extreme positions (part of the extreme right-hand position of one of the lower channels 4 being shown chain-dotted at 4*a* in FIG. 1).

Mounted from the upper channels 2 immediately above the fingers 18 are a pair of brackets 22 which support two stack gripping assemblies 24 and 26, comprising pneumatic tubes 30 and 31 respectively. Since these assemblies are alike, only the upper one 24 will be described.

A tubular member 28 is mounted from the brackets 22 and supports an end portion of the pneumatic tube 30 whose end is closed by a plug 32. The other end of the tube 30 is connected to a source of air pressure (not shown).

A square aperture 34 is formed in the member 28 at the side facing the stack S; and loosely mounted from the upper channels 2 at a position between the aperture 34 and the stack S is a thin T-shaped metallic strip 36 having a layer of rubber formed on its inner surface for gripping the side of the stack S.

The tube 30, which is made of rubber or a similar resilient material, has a thinner wall section at a portion 38 around the aperture 34, so that when air pressure is applied to the portion 38 it distends through the aperture and grippingly engages the adjacent side of the stack S via the strip 36, as shown in FIG. 2. Alternatively, instead of the tube portion 38 having a thinner section, the other portions of the tube 30 outside the member 28 may be of thicker section or may be supported to prevent their distending.

Figure 3:
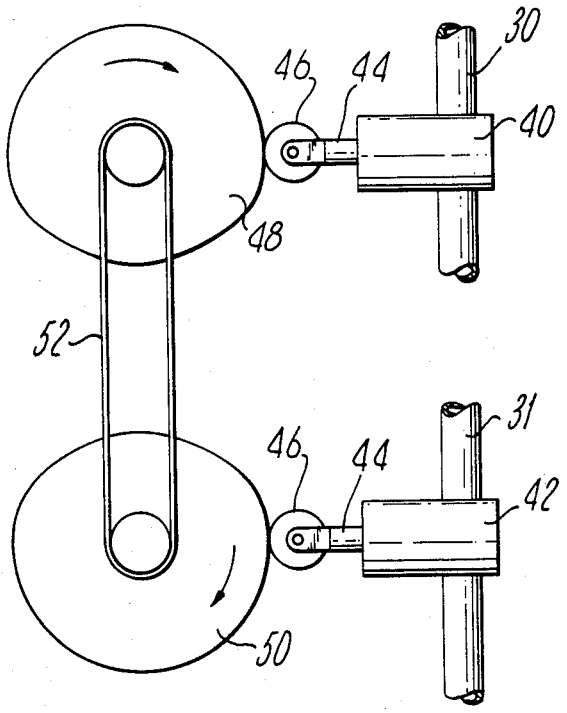
FIG. 3 is a detail of a part of the apparatus not shown in FIG. 1.

Referring now also to FIG. 3, there are shown a pair of valves 40, 42 respectively connecting the tubes 30, 31 to a source of air pressure. The valves 40, 42 each have slides 44 connected to roller cam followers 46, which are actuated by cams 48 and 50 respectively. One of the cams is driven clockwise at a speed of approximately 30 r.p.m. and drives the other cam clockwise at the same speed through a toothed coupling belt 52.

The shape of the cams 48, 50 is such that each valve 40 and 42 is closed for about 120° of rotation. The points of closure of the valves are 180° out of phase with one other, and before closing of each valve there is a period of overlap of about 60° when both valves are open. In the position shown in FIG. 3 the cams 48, 50 are at the middle of such overlap position, the valve 40 having been opened by the cam 48 about 30° previously.

In front of each gripper assembly 24, 26 there is connected in the respective tube 30 and 31 a bleed valve 54 incorporating a threaded pointed valve member 56. Adjustment of the member 56 varies the time taken for the portion of the tube 30 or 31, to become deflated after closure of the respective valve 40 or 42.

In operation, stamps are withdrawn from the bottom of the stack S (at a rate of about 350 stamps per minute) by suction being applied to successive raised portions 12 of the rotor 10, as above described. Thus the level of the stamps in the pivotal lower channels 4 steadily drops.

Commencing from the position shown in FIG. 3 at which both valves 40 and 42 are open so that the stack S is gripped by both assemblies 24 and 26, further rotation of the cam 50 causes the valve 42 to close, allowing air pressure in the tube 31 to be reduced by leakage through the bleed valve 54, until the tube portion 38 of the lower gripper assembly 26 has become deflated. Thereby the T-shaped strip 36 is released, allowing the portion of the stack between the gripper assemblies 24 and 26 to drop along with the lower part of the stack. After some 120° of further rotation of the cam 50, the valve 42 opens, causing re-inflation of the portion 38 of the tube 31, so that the lower assembly 26 again grips the side of the stack. About 60° thereafter the cam 48 closes the valve 40, similarly allowing the air pressure in the tube 30 to be reduced, and the upper gripper assembly 24 to be released, so that the upper part of the stack lowers and becomes supported by the lower gripper assembly 26.

In this manner the gripper assemblies 24 and 26 continue to operate cyclically in the manner of an escapement mechanism, enabling stamps to be fed in a controlled manner towards the bottom of the stack, without allowing the full weight of the stack S to be transmitted to the bottom supporting ledges 8.

When the upper level of stamps in the stack has dropped to just above the upper assembly 24, the operator needs to manually replenish the stack. In order to give some advance warning of this situation to the operator, a stack sensor 58 (e.g. a photoelectric cell) is positioned above the assembly 24. Provided the level of the stack does not drop below the assembly 24, the apparent weight of the stack at the ledges 8 will remain practically constant, fluctuating only at each cycle of operations of the assemblies 24 and 26 due to the weight of stamps therebetween.

It is, of course, possible to allow the level of the stack S to drop to the lower channel 4, but it will then be more difficult to replenish the stamps through the gripper assemblies 24 and 26.

If withdrawal of stamps from the bottom of the stack is to be inhibited from some time while the machine continues running (e.g. if there is a didiscontinuity of packets due to some packets being rejected), it is arranged that the drive to the cams 48, 50 is interrupted so that the full weight of the stack doe not tend to be transmitted to the ledges 8.

Though the valves 40 and 42 are described above as being operated mechanically by the cams 48 and 50, they may instead be electro-mechanically operated from an oscillating circuit whose frequency may be coupled to the speed of the machine.

We claim:

1. Apparatus for feeding a stack of sheets, such as stamps for cigarette packets, comprising:

(a) a substantially vertically disposed guide means, having top and bottom ends, for defining a stack of superposed sheets, the cross-sectional dimensions of said guide means being greater than that of said sheets and said bottom end of said guide means comprising stack support means;

(b) suction withdrawal means for withdrawing sheets singly at a predetermined rate from said bottom end of said guide means;

(c) upper and lower gripping means disposed intermediate said top and bottom ends of said guide means and spaced from said bottom end and from each other, said upper and lower gripping means being operable to project into said guide means for gripping solely against the side edges of said sheets in said stack; and (d) actuating means operable at a rate slower than said predetermined rate of said withdrawal means to alternately operate said upper and lower gripping means such that, while sheets are withdrawn from said bottom end of said guide means by said withdrawal means and the part of said stack below said gripping means is lowered, the part of said stack above said gripping means is supported alternately by said upper and lower gripping means to lower said part of said stack above said gripping means at intervals corresponding to the operating rate of said actuating means;

(e) whereby said stack of sheets are fed downwardly in a controlled manner towards said bottom end of said guide means without the full weight of said stack being transmitted to said stack support means at said bottom end of said guide means and with the weight of said stack on said stack support means remaining substantially constant.

2. Apparatus as claimed in claim 1 in which each said gripping means comprises a tubular inflatable member disposed along at least one side of said stack parallel to the edges of said sheets therein.

3. Apparatus as claimed in claim 2 in which said actuating means comprises a pair of valves, each connecting one of said inflatable members to a source of air pressure, and driven cam means arranged to alternately operate said valves to alternately inflate said inflatable members.

4. Apparatus as claimed in claim 2 in which between each inflatable member and aid one side of said stack there is interposed a thin pivotal member to distribute the resultant gripping pressure along the edges of the respective sheets.

5. Apparatus as claimed in claim 1 and further comprising a stack sensor disposed above said gripping means to indicate when replenishment of said stack is required.

6. Apparatus as claimed in claim 1 wherein said actuating means is operable during each cycle of operation to alternately operate said upper and lower gripping means such that said lower gripping means is activated to a gripping position before said upper gripping means is deactivated to a non-gripping position whereby said part of said stack above said gripping means is lowered only to the level of said lower gripping means.

* * * * *